United States Patent [19]

Grubb, Jr. et al.

[11] Patent Number: 4,941,813

[45] Date of Patent: Jul. 17, 1990

[54] MOLD GUIDANCE SYSTEM FOR BLOCK MAKING MACHINERY

[76] Inventors: Lloyd T. Grubb, Jr., Rte. 7, Box 250, Apex, N.C. 27502; Joseph T. Kennamer, 1606 Dunblane Crt., Cary, N.C. 27511

[21] Appl. No.: 283,832

[22] Filed: Dec. 13, 1988

[51] Int. Cl.[5] ..... B28B 3/02

[52] U.S. Cl. ..... 425/195; 100/918; 425/253; 425/413; 425/421; 425/432; 425/452

[58] Field of Search ..... 425/195, 253, 413, 421, 425/432, 452, 456; 100/918

[56] References Cited

U.S. PATENT DOCUMENTS

| | | | |
|---|---|---|---|
| D. 225,846 | 1/1973 | Cruzen, Jr. | D18/2 |
| 1,523,936 | 1/1925 | Easterday | 425/421 |
| 2,652,613 | 9/1953 | Warren | 425/421 |
| 2,842,827 | 7/1958 | Nickelson | 425/413 |
| 3,006,053 | 10/1961 | Miller | 425/421 |
| 3,128,522 | 4/1964 | Benjey et al. | 425/452 |
| 3,310,854 | 3/1967 | Zevely | 425/413 |
| 3,545,053 | 12/1970 | Besser | 425/150 |
| 3,608,162 | 9/1971 | Staton | 425/457 |
| 3,660,004 | 5/1972 | Woelk | 425/452 |
| 3,679,340 | 7/1972 | Springs | 425/163 |
| 3,696,945 | 10/1972 | Bobolts | 214/6 G |
| 3,832,119 | 8/1974 | Woelk | 425/432 |
| 3,833,331 | 9/1974 | Springs | 425/253 |
| 3,923,451 | 12/1975 | Woelk | 432/138 |
| 3,963,397 | 6/1976 | Cruzen et al. | 425/141 |
| 4,036,570 | 7/1977 | Cruzen et al. | 425/141 |
| 4,095,925 | 6/1978 | Cruzen et al. | 425/141 |
| 4,199,287 | 4/1980 | Salts | 414/68 |
| 4,235,580 | 11/1980 | Springs et al. | 425/211 |
| 4,260,352 | 4/1981 | Balhorn | 425/211 |
| 4,312,242 | 1/1982 | Wallis | 74/87 |
| 4,395,213 | 7/1983 | Springs et al. | 425/211 |
| 4,456,449 | 6/1984 | Schubert et al. | 425/253 |
| 4,498,831 | 2/1985 | Salts | 414/46 |
| 4,505,630 | 3/1985 | Kaschner et al. | 414/152 |
| 4,531,304 | 7/1985 | Wauhop, Jr. et al. | 34/30 |
| 4,553,893 | 11/1985 | Kaschner et al. | 414/152 |
| 4,712,975 | 12/1987 | Salts | 414/786 |

*Primary Examiner*—James C. Housel

*Attorney, Agent, or Firm*—Richard E. Jenkins

[57] ABSTRACT

A mold guidance system for preventing horizontal movement of the mold of a concrete block making machine including, on each side of the machine, a mold support arm extending laterally outwardly from the inside corner of the mold and including a bushing in the outer end thereof, a first clamp secured to the side of the machine frame above the mold arm bushing, a second clamp element secured to the side of the machine frame below the mold arm bushing, and an elongate pin slidably movable within the mold arm bushing and fixedly engaged at the upper end by the first clamp and at the lower end by the second clamp. The mold guidance system prevents horizontal movement of the mold so as to reduce mold wear and increase mold life.

10 Claims, 6 Drawing Sheets

MOLD GUIDANCE SYSTEM FOR BLOCK MAKING MACHINERY

DESCRIPTION

1. Technical Field

The present invention relates to block molding machines of the type adapted to automatically produce building blocks of concrete or similar materials, and more particularly to an improved mold guidance system for block molding machines so as to reduce mold wear and consequently increase mold life.

2. Background Art

It is conventional practice in the automatic molding of concrete blocks and the like to utilize a concrete block manufacturing machine wherein mixed concrete is delivered to a supply hopper from which successive and substantially uniform amounts are withdrawn and then delivered to a mold mounted within the machine frame and which is open at both its top and bottom. A pallet is held against the open bottom of the mold by a vertically movable pallet support and a stripper head is positioned vertically above and spaced apart from the mold a sufficient distance so as to enable the loading mechanism to move forward into position above the mold and discharge a discrete selected amount of concrete mix into the mold. The loading mechanism is then withdrawn rearwardly from between the mold and the stripper head, and the stripper head is vertically lowered into the mold and the mold simultaneously vibrated in order to compact the concrete. Thereafter, the pallet support and stripper head are simultaneously lowered relative to the concrete block forming mold in order to strip the concrete blocks from within the mold. The freshly molded blocks are supported on a pallet and removed by a conveyor line from the block molding machinery to a stacking assembly and from there to a kiln for curing. This block making process requires only approximately 8.5 seconds from initiation to completion and is repeated continuously for the molding of additional blocks.

In the manufacture of concrete and similar blocks, it is conventional manufacturing practice to vibrate the mold following introduction of the concrete material into the mold and prior to ejection of the molded block onto the conveyor. Prior to the vibration of the mold, the stripper head has moved vertically downwardly into aligned association with the upper end of the mold where it rests on the concrete material, and the stripper head remains within the mold during the entire period of mold guidance system is provided with the BESSER V3-12 VIBRAPAC and V3R VIBRAPAC block molding machines to minimize lateral motion while allowing vertical motion of the mold during the mold vibration period of the concrete block forming cycle. The pin-type guidance system comprises a pin which extends downwardly from a forwardly extending arm on each side of the machine frame and through a respective nylon bushing at each front corner of the mold. In this fashion, lateral motion is inhibited while vertical motion of the mold is allowed by virtue of the mold moving vertically along a portion of the length of the two pins extending through the aforementioned bushings. However, is is well known that the conventional pin-type mold guidance system does not adequately prevent lateral motion of the mold during the block forming process and that this results in significant mold wear due to lack of proper alignment with the stripper head.

The present pin guidance system induces excessive vibratory loads on the machine frame through the support arms and thereby causes premature metal fatigue and catastrophic failure which results in substantial repair expense as well as machine downtime. Thus, there has long been a recognized need for an improved mold guidance system for this type of block making machine but heretofore no one has been able to discover a satisfactory solution to this problem.

DISCLOSURE OF THE INVENTION

Block making machinery constructed in accordance with a preferred embodiment of the present invention incorporates an improved mold guidance system for inhibiting lateral mold movement during the block making process and comprises a mold support arm extending laterally outwardly from each side of the mold adjacent to the inner corner of the mold wherein each arm includes a bushing in the outer end thereof, a pair of first clamp elements each secured to a respective side of the machine frame above an elongate opening defined in the frame upon which the mold is supported and in vertical alignment with a respective mold arm bushing, a pair of second clamp elements each secured to a respective side of the machine frame below the elongate opening defined in the frame upon which the mold is supported and in vertical alignment with a respective mold arm bushing, and a pair of elongate cylindrical pins each being adapted to be slidably positioned within a respective one of the mold arm bushings and to be fixedly engaged at one end by a respective one of said pair of first clamp elements and at the other end by a respective one of said pair of second clamp elements. Also provided in the preferred embodiment of the invention is a vertically extending reinforcement plate extending between the first and second clamp elements on each side of the mold making machine frame and secured at each end to a respective first and second clamp element in order to provide greater rigidity and strength to the mold guidance system of the invention.

It has been discovered that the aforementioned improvement in mold guidance systems for concrete block manufacturing machines as described herein results in the extraordinary and highly unexpected result of the molds lasting approximately twice as long as heretofore. This provides for substantially reduced operating costs for the concrete block manufacturing machinery, reduced manpower requirements, and increased productivity.

An object of the present invention is to provide an improved mold guidance system for the vibratable mold of a concrete block making machine to prevent lateral movement of the mold during the block making process to increase mold life.

Another object of the present invention is to provide for an improved mold guidance system for the vibratable mold of a concrete block making machine so as to prevent the breaking of the machine frame and the resulting machinery downtime resulting from the aforesaid machine parts breakage.

Other objects and advantages of the present invention will be pointed out specifically or will become apparent from the following description when it is considered in conjunction with the appended claim and the accompanying drawings.

BEST MODE FOR CARRYING OUT THE INVENTION

Figure 1:
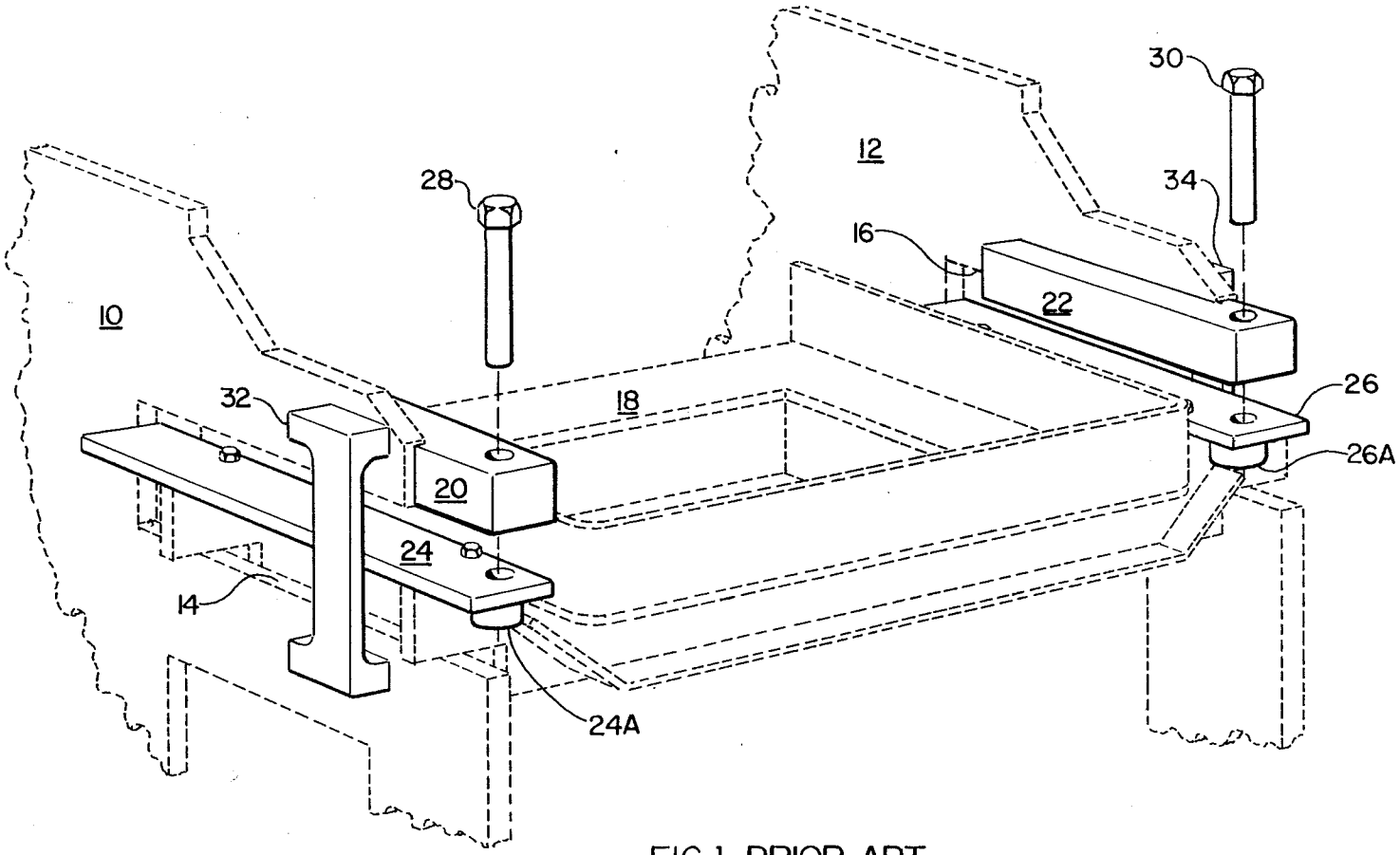
FIG.1. PRIOR ART
FIG. 1 is a fragmentary, perspective view of a concrete block making machine constructed in accordance with the prior art pin-type mold guidance system.

Referring now to the drawings, FIG. 1 depicts the pin-type mold guidance system of a conventional concrete block making machine (BESSER V3R VIBRAPAC and BESSER V3-12 VIBRAPAC) in solid lines and fragmentary adjacent portions of the machine in broken lines. The remainder of the block making machine is not shown but is well known to those familiar with the manufacture of concrete blocks. As can be seen in FIG. 1, the concrete block making machine has a rigid frame including left frame side 10 and opposing right frame side 12. Frame sides 10 and 12 each define a horizontal elongate opening therein, 14 and 16, respectively. A mold box 18, hereinafter referred to as a "mold", is in contact with and supported on each side thereof within elongate openings 14 and 16. The conventional BESSER pin-type mold guidance system (S.O.P. No. 642369) shown in solid lines includes pin guide support arm 20 on the left hand side of the machine and pin guide support arm 22 on the right hand side of the machine. A support plate 24 including nylon bushing 24A is secured to the left side of mold 18, and support plate 26 including nylon bushing 26A is secured to the right side of mold 18. A guide pin 28 is provided for the left hand side of the pin-type mold guidance system and extends downwardly through pin guide support arm 20 and nylon bushing 24A of support plate 24. Correspondingly, guide pin 30 is provided for the right hand side of the machine and extends downwardly through pin guide support arm 22 and nylon bushing 26A of support plate 26. Left side support 32 and right side support 34 serve to reinforce frame sides 10 and 12, respectively. In this fashion, the guidance system tends to restrict lateral (front to back and side to side) movement of mold 18 while allowing sliding vertical movement of mold 18 along a portion of the length of guide pins 28 and 30.

Although intended to control motion of mold 18 in horizontal directions and thus reduce mold wear, horizontal or lateral movement of mold 18 does, in fact, occur during block manufacturing, particularly during the vibration cycle of the block manufacturing process. Moreover, pin guide support arms 20 and 22 as well as machine frame sides 10 and 12 have been known to be broken by the metal fatigue resulting from excessive vibratory forces during block manufacture and thus to result in machine downtime while they are repaired and replaced. Since the mold guidance system described herein is conventional and known to those familiar with the art, applicant does not believe that further description relating thereto is necessary in order to fully understand the instant invention.

Figure 2:
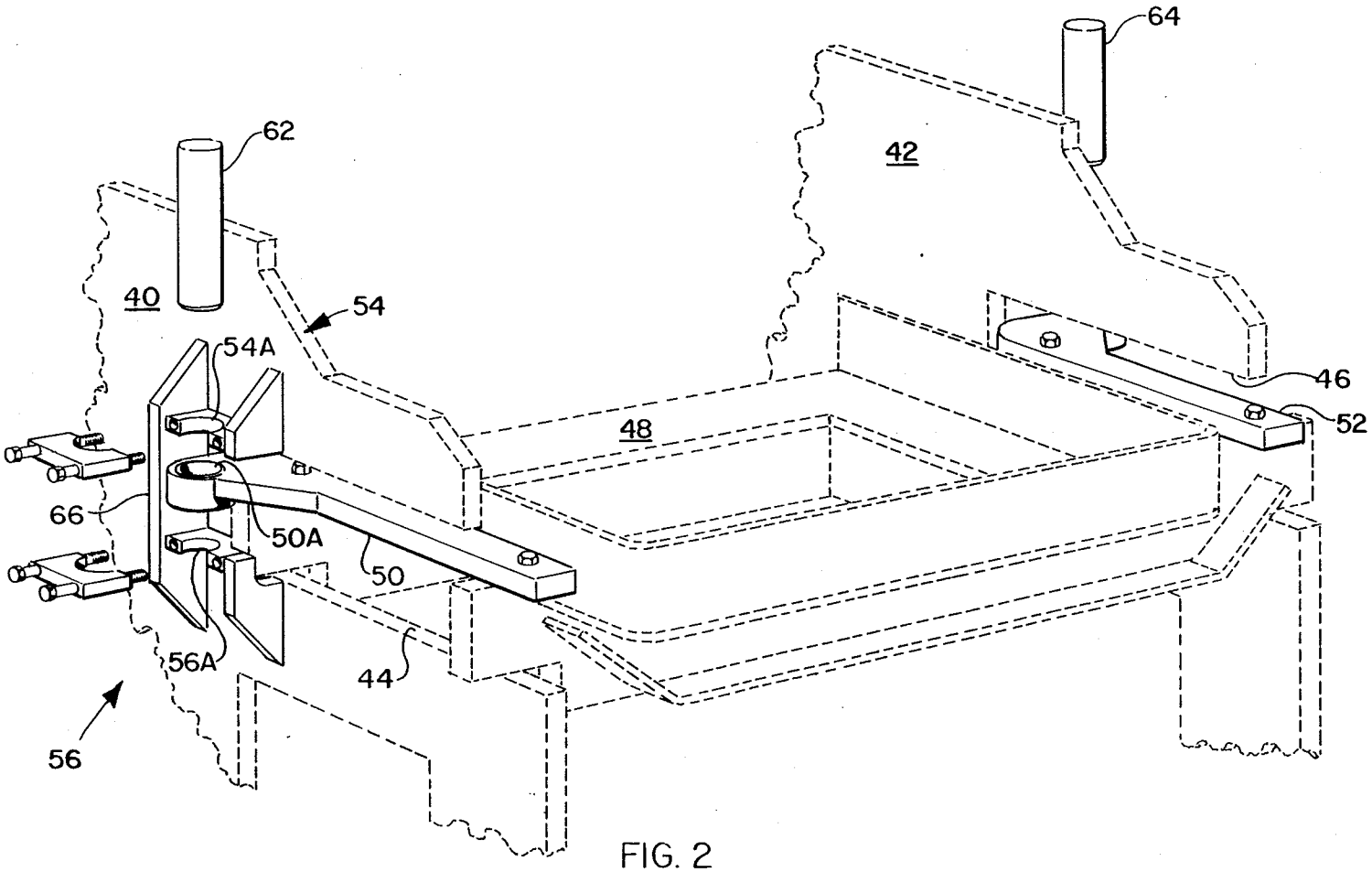
FIG. 2 is a fragmentary, perspective view of a concrete block making machine constructed in accordance with the present invention.

With reference now to FIG. 2 of the drawings, the relevant portions of the BESSER block making machine is again depicted in phantom lines with applicant's improved mold guidance system shown in solid lines. With specific reference to FIG. 2, left frame side 40 and right frame side 42 are shown. Left frame side 40 defines horizontal elongate opening 44 therein and right frame side 42 defines horizontal elongate opening 46 therein. Mold 48 extends between frame sides 40 and 42, and the opposing sides thereof rest on and are supported by elongate openings 44 and 46, respectively. The aforementioned parts of the concrete block machine are conventional and identical to those described in FIG. 1. Applicant's improved mold guidance system is shown in solid lines and comprises a first mold support arm 50 rigidly secured to the left side of mold 48 by conventional bolts and nuts or in any other suitable manner. Mold support arm 50 extends outwardly from the back corner of mold 48 and includes a nylon bushing 50A in the terminal end thereof. A second mold support arm 52 is secured to the right side of conventional mold 48 and extends outwardly from the rear corner thereof. Mold support arm 52 also includes a nylon bushing 52A in the terminal end thereof. Although other materials are contemplated by the invention, mold support arms 50 and 52 most suitably are constructed of steel and bushings 50A, 52A are most suitably constructed of nylon but also may be constructed of any material possessing good friction wear resistance characteristics.

A first clamp element 54 is secured to left frame side 40 by suitable means such as nuts and bolts, welding or the like so as to be rigidly positioned above elongate opening 44 and in vertical alignment with bushing 50A. A second clamp element 56 is secured in like manner to left frame side 40 below elongate opening 44 and also in vertical alignment with bushing 50A. Both first clamp element 54 and second clamp element 56 define an aperture therein, 54A and 56A respectively, which are in vertical axial alignment with bushing 50A. Corresponding first clamp element 58 and second clamp element 60 are provided on right frame side 42 so as to be in substantial vertical alignment with nylon bushing 52A carried by support arm 52. Upper first clamp element 58 and lower second clamp element 60 each also define an aperture therein, 58A and 60A respectively, which are in vertical axial alignment with nylon bushing 52A. Finally, an elongate cylindrical guide pin 62, most preferably constructed of casehardened cold finished steel, is provided to be slidably received within nylon bushing 50A and fixedly secured at one end to first clamp element 54 and at the other end to be fixedly secured to second clamp element 56. A corresponding guide pin 64 is provided for the other side of the mold guidance system of the invention to be slidably received within nylon bushing 52A and fixedly secured at its upper end within aperture 58A of first clamp element 58 and at its lower end within aperture 60A of second clamp element 60.

Although optional, the preferred embodiment of the guidance system of the invention provides vertically extending strength members 66 and 68 for the left side and right side, respectively, of the block making machine for rigidly connecting the upper and lower clamp elements together to impart enhanced strength and rigidity to the mold guidance system. Specifically, strength member 66 extends from first clamp element 54 to second clamp element 56 and is secured, preferably, by welding, to the side of each clamp (see FIG. 3). Correspondingly, strength member 68 extends vertically from first clamp member 58 to second clamp member 60 and is fixedly secured to the side of each clamp (see FIG. 4). In this fashion, the mold guidance system of the invention serves to prevent horizontal motion of mold 48 while allowing desirable vertical motion thereof during the block making process. The guidance system is constructed so as to better control vibratory forces and has been found not to suffer the breakage of machine frames or their support arms as is common to the prior art mold guidance system illustrated in FIG. 1 of the drawings. Also, very surprisingly, applicant has discovered that the novel mold guidance system results in such significant mold wear reduction that the mold will have a useful life of more than 200% of mold life with the conventional mold guidance system. This increase in mold life is apparently due to the positioning of the elements of the pin guidance system adjacent the rear corners of the mold in conjunction with providing securement of each of the guide pins at both ends thereof to the machine frame.

Figure 3:
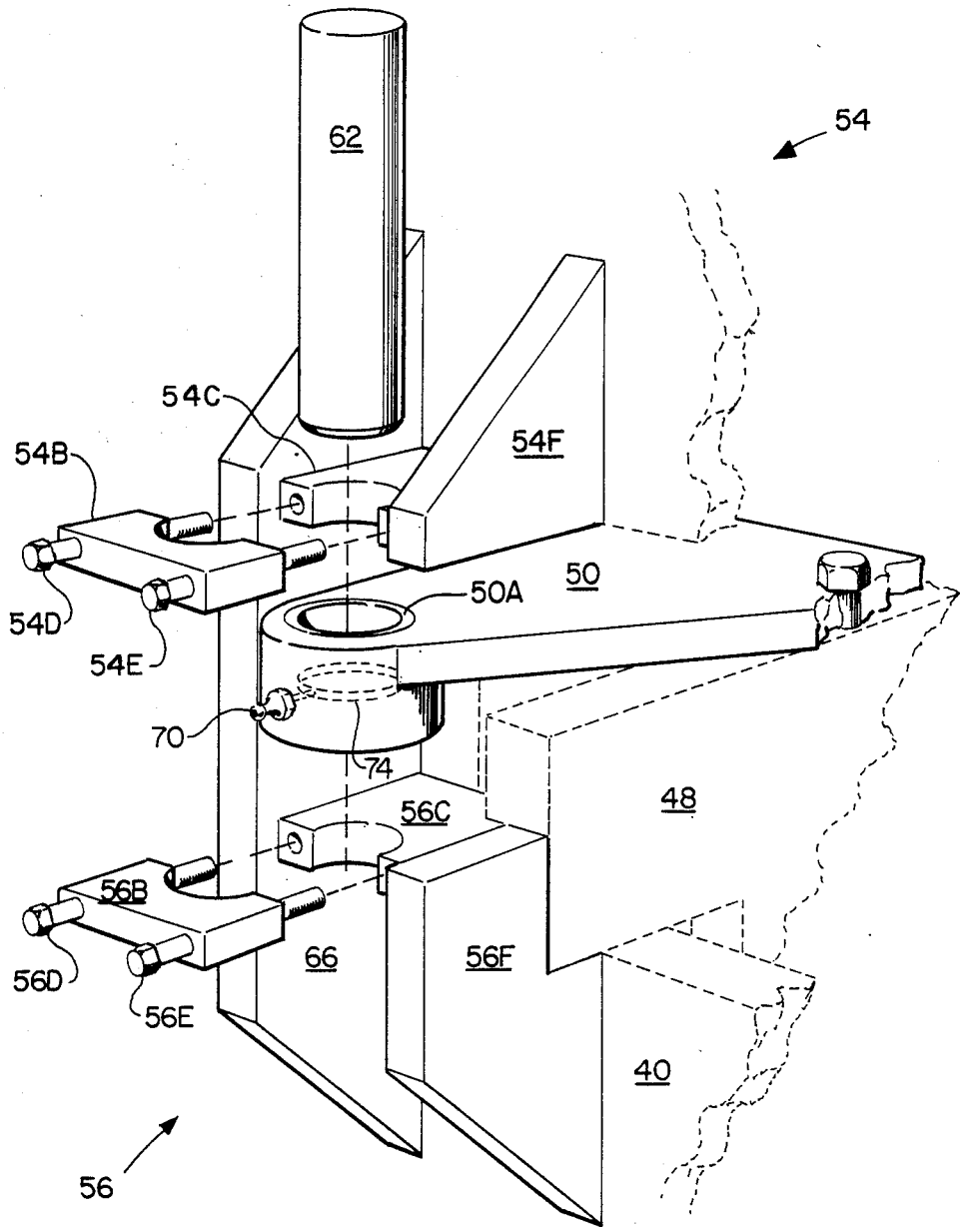
FIG. 3 is an enlarged perspective view of the left side unit of the mold guidance system of the present invention.
Figure 4:
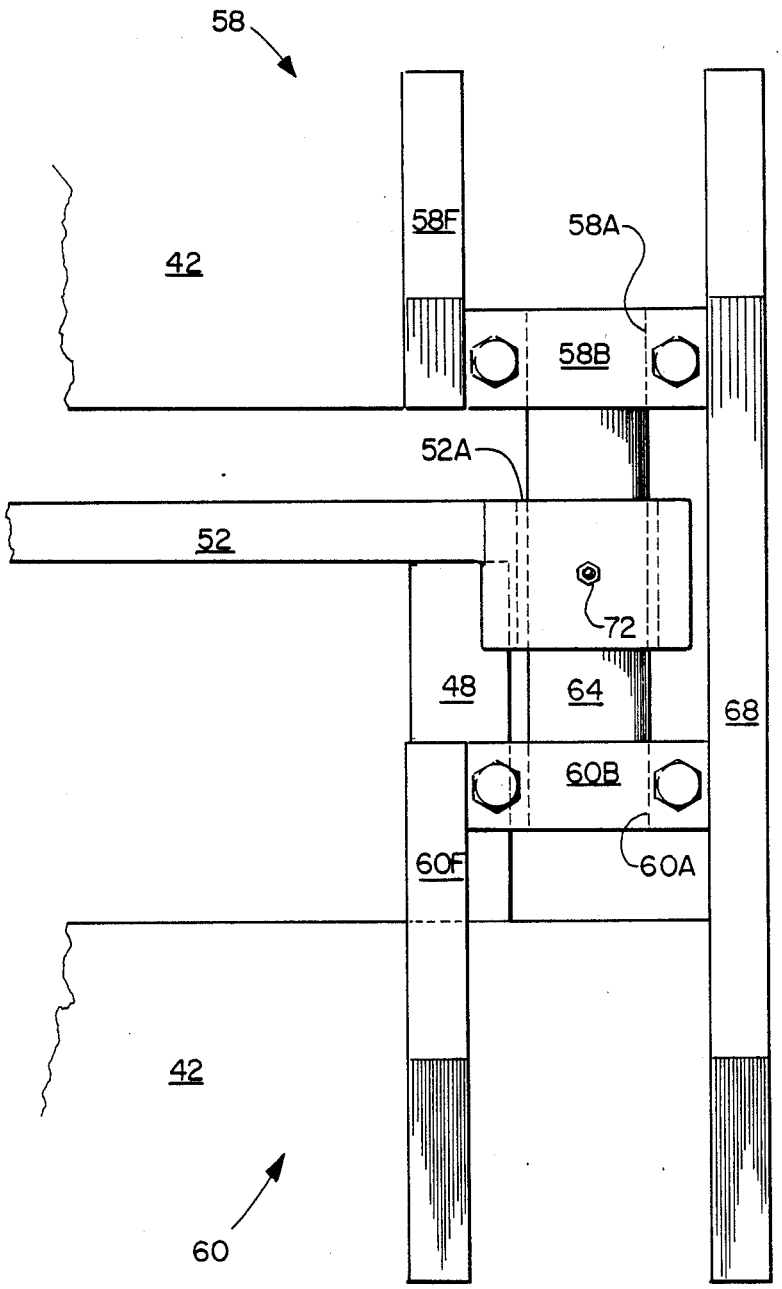
FIG. 4 is a front elevational view of the right side unit of the mold guidance system of the present invention.
Figure 5:
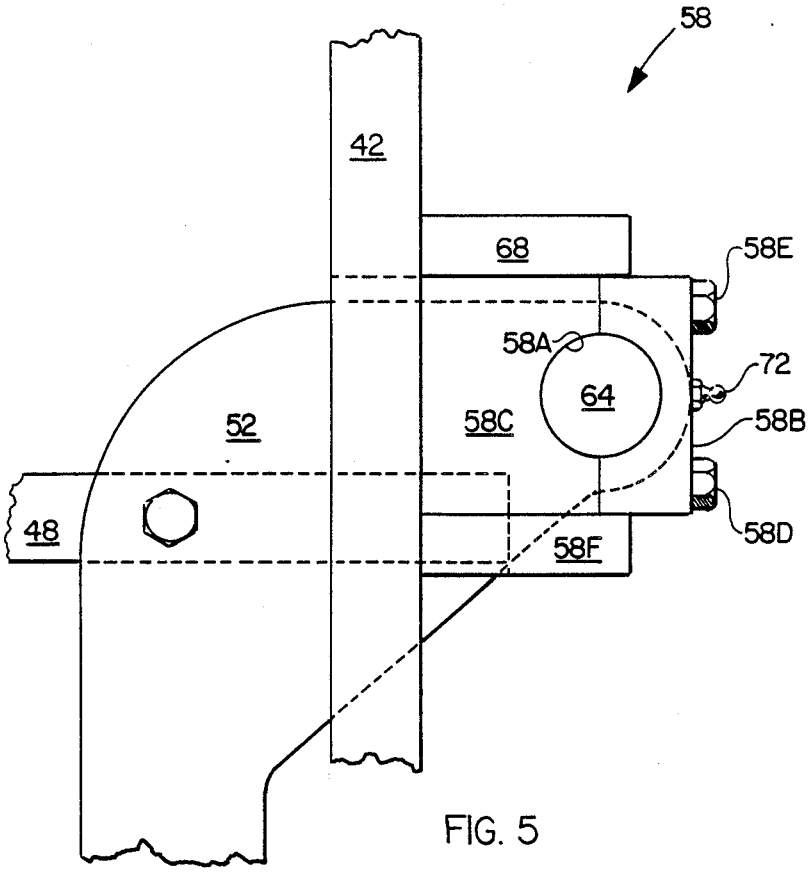
FIG. 5 is a top plan view of the right side unit of the mold guidance system of the present invention.
Figure 6:
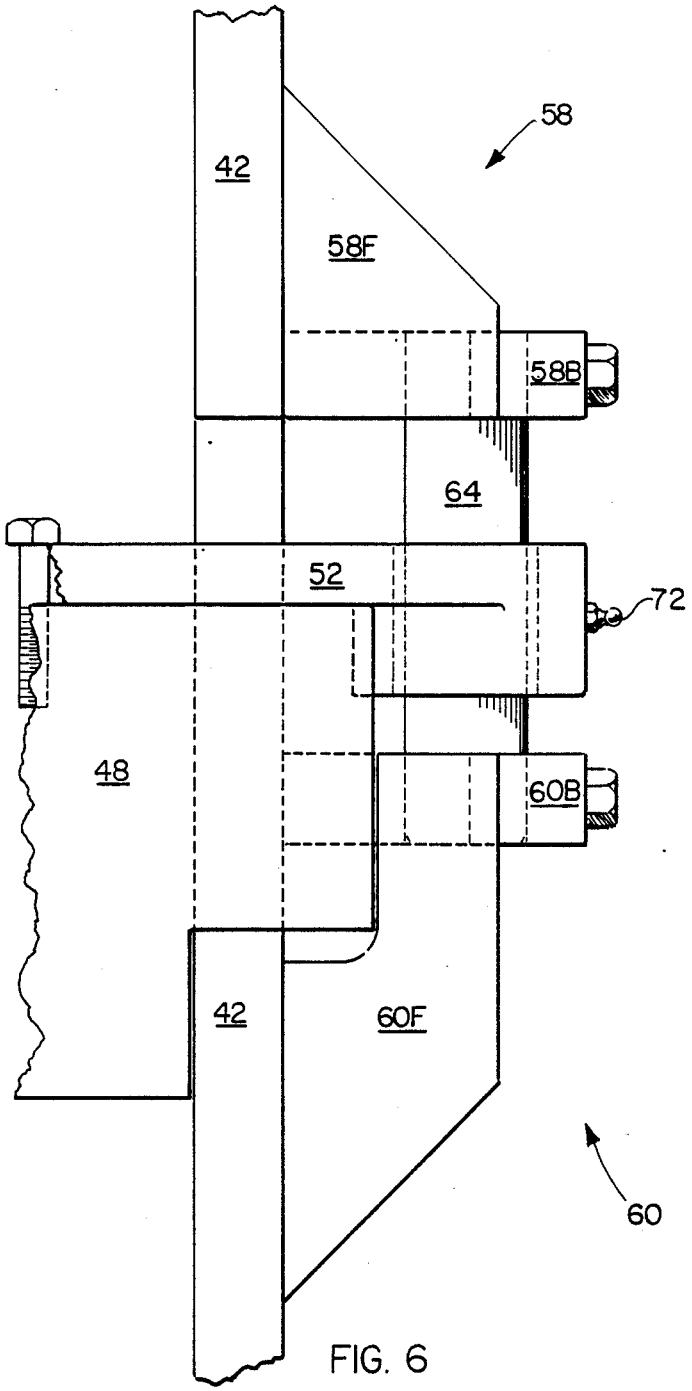
FIG. 6 is a side elevation view of the right side unit of the mold guidance system of the present invention.

The invention has been broadly disclosed and described with reference to FIGS. 1 and 2, but applicant now refers to FIGS. 3–6 to explain in greater detail the construction of the left frame side (FIG. 3) and the right frame side (FIGS. 4–6) of the mold guidance system which, for clarity of understanding, should be appreciated as being mirror images of each other but otherwise to be identical in construction. As best seen in FIG. 3, upper clamp element 54 comprises two base portions 54B, 54C which when secured together with bolts 54D and 54E serve to fixedly engage the upper end of guide pin 62 within aperture 54A defined thereby. First clamp element 54 also includes side plate 54F abutting one side of base portions 54B, 54C and strength member 66 abutting the opposing side of base portions 54B, 54C. Clamp element 56 comprises medially split base portions 56B, 56C which are secured together by bolts 56D, 56E so as to define aperture 56A for fixedly engaging the bottom end of guide pin 62 therein. Clamp element 56 also includes side plate 56F which abuts one side of base portions 56B, 56C and the other side thereof is abutted by the previously described vertically extending strength member 66 which extends from clamp element 54 to clamp element 56 and is fixedly secured to each to provide additional strength to the mold guidance system. It is contemplated that strength member 66 and base portion 54C and side plate 54F of clamp element 54 as well as base portion 56C and side plate 56F of clamp element 56 will most suitably be welded to machine frame side 40 therebeneath. Mold support arm 50 is most preferably bolted to the left side of mold 48 although it could also be suitably secured thereto in any other fashion such as welding which results in a rigid and permanent attachment.

Right hand side upper clamp element 58 also comprises two base portions 58B, 58C secured together with bolts 58D, 58E (see FIG. 5) to engage the upper end of guide pin 64 with aperture 58A, and right side lower clamp element 60 comprises base portions 60B, 60C secured together by bolts 60D, 60E to engage the lower end of guide pin 64 within aperture 60A. Both left side and right side clamp members are constructed from steel.

With reference again to FIGS. 3–6, applicant wishes to note that in the preferred embodiment of the invention nylon bushing 50A (FIG. 3) and nylon bushing 52A (FIGS. 4–6) will be provided with grease fittings 70 and 72, respectively, which are in communication with grooves 74 and 76 (not shown), respectively, provided around the inner circumference of nylon bushings 50A, 52A. Thus, the bushings may be periodically greased through grease fittings 70, 72 and grooves 74, 76 will serve as reservoirs for the grease and thus facilitate slidable movement of guide pins 62, 64 within nylon bushings 50A, 52A of mold support arms 50, 52.

As noted above, applicant has observed that the instant invention results in the machine mold having a mold life of more than 200% of the useful mold life possible heretofore. In a plant test at Adams Products Company in Morrisville, N.C. applicant ran a BESSER V3-12 VIBRAPAC machine for a 276 hour production run of 310,516 lightweight concrete blocks and obtained the test results set forth in Table 1 below:

TABLE 1

| | Prior Art Mold Guide System | Improved Mold Guide System |
|---|---|---|
| Mold Life | 140,000 Concrete Blocks Per Mold | Approximately 300,000 Concrete Blocks Per Mold |

These results indicate the surprising and unexpected result that mold wear was so substantially reduced by applicant's novel mold guide system that the mold was capable of a productive life of more than two times as long as heretofore possible. Along with the increased mold life, applicant discovered that the productivity of the block making machine increased about 14 percent (which is believed to be due to the reduced vibration cycle time achieved through the use of applicant's mold guide system) and the noise level of the block making machine was discernably reduced. Also, and very importantly, the longer mold life reduces the consumption of strategic metals such as chromium, nickle, manganese, vanadium and tungsten that are used to impart abrasion resistance to the metal from which the molds are fabricated.

It will thus be seen that there has been described above an improved mold guidance system for concrete block and the like machines which results in surprising and unexpected increases in useful mold life. Although described with particular reference to BESSER V3R and V3-12 VIBRAPAC block making machines, applicant contemplates that the guidance system of the invention can be used with any type of block making machine of similar construction to the BESSER machines.

It will be understood that various details of the invention may be changed without departing from the scope of the invention. Furthermore, the foregoing description is for the purpose of illustration only, and not for the purpose of limitation—the invention being defined by the claims.

What is claimed is:

1. In combination with a concrete block making machine having a frame defining a horizontally extending elongate opening in each of two opposing sides thereof, each of said openings having an open end and a closed end, an open bottom mold to receive material therein for molding blocks and defining two inside corners adjacent said closed ends of said openings and two outside corners adjacent said open ends of said openings, said mold being supported on each opposing sides thereof within said respective openings and being mounted for vibratory movement relative to said frame, a head member movable into said mold for compacting block molding material placed therein, a pallet support adapted to lift and hold a pallet against the bottom of said mold when a block is being molded and to then drop to allow for ejection of the completed molded block from the mold, the improvement which comprises:

a mold guidance system comprising:

a mold support arm secured to and extending laterally outwardly from each of said opposing sides of said mold substantially adjacent the two inside corners thereof, and each arm defining an aperture in an outer end thereof;

a pair of first clamp elements each secured to a respective side of said frame above said opening defined therein and adjacent to said closed end of said opening in substantial vertical alignment with a respective mold arm aperture;

a pair of second clamp elements each secured to a respective side of said frame below said opening defined therein and adjacent to said open end of said opening in substantial vertical alignment with a respective mold arm aperture; and a pair of elongate pins each being slidably positioned within a respective one of the mold arm apertures and fixedly engaged by a respective one of said pair of first clamp elements and a respective one of said pair of second clamp elements;

whereby said mold may move vertically on said elongate pins during vibration thereof during the concrete block making process but is prevented from moving laterally.

2. In combination with a concrete block making machine according to claim 1 wherein the aperture within each of said mold support arms comprises a bushing.

3. In combination with a concrete block making machine according to claim 2 wherein said bushings are nylon bushings and said mold support arms are steel.

4. In combination with a concrete block making machine according to claim 1 wherein said first and second clamp elements on each side of said concrete block making machine frame are fixedly secured together by a vertically extending reinforcement element therebetween.

5. In combination with a concrete block making machine according to claim 1 wherein said first and second clamp elements each define an aperture therein for receiving an end of a respective pin and wherein each clamp is adapted to fixedly engage the end of said pin therein.

6. In combination with a concrete block making machine according to claim 5 wherein said first and second clamp elements are steel.

7. In combination with a concrete block making machine according to claim 1 wherein said elongate pins each comprise a cylindrical steel bar.

8. In combination with a concrete block making machine having a frame defining a horizontally extending elongate opening in each of two opposing sides thereof, each of said openings having an open end and a closed end, an open bottom mold to receive material therein for molding blocks and defining two inside corners adjacent said closed ends of said openings and two outside corners adjacent said open ends of said openings, said mold being supported on opposing sides thereof within said respective openings and being mounted for vibratory movement relative to said frame, a head member movable into said mold for compacting block molding material placed therein, a pallet support adapted to lift and hold a pallet against the bottom of said mold when a block is being molded and to then drop to allow for ejection of the completed molded block from the mold, the improvement which comprises:

a mold guidance system comprising:

a mold support arm secured to and extending laterally outwardly from each of said opposing sides of said mold substantially adjacent the two inside corners thereof, and each arm comprising a bushing in an outer end thereof;

a pair of first clamp elements each secured to a respective side of said frame above said opening defined therein and adjacent to said closed end of said opening in substantial vertical alignment with a respective mold arm bushing;

a pair of second clamp elements each secured to a respective side of said frame below said opening defined therein and adjacent to said open end of said opening in substantial vertical alignment with a respective mold arm bushing; and a pair of elongate cylindrical pins each being slidably positioned within a respective one of the mold arm bushings and fixedly engaged by a respective one of said pair of first clamp elements and a respective one of said pair of second clamp elements;

whereby said mold may move vertically on said elongate pins during vibration thereof during the concrete block making process but is prevented from moving laterally.

9. In combination with a concrete block making machine according to claim 8 wherein said first and second clamp elements on each side of said concrete block making machine frame are fixedly secured together by a vertically extending reinforcement element therebetween.

10. In combination with a concrete block making machine according to claim 8 wherein said first and second clamp elements each define an aperture therein for receiving an end of a respective cylindrical pin and wherein each clamp is adapted to fixedly engage the end of said pin therein.

* * * * *